US008783690B1

(12) United States Patent
Green

(10) Patent No.: US 8,783,690 B1
(45) Date of Patent: Jul. 22, 2014

(54) BALANCING GAME APPARATUS

(71) Applicant: Scott D. Green, Irondale, AL (US)

(72) Inventor: Scott D. Green, Irondale, AL (US)

( * ) Notice: Subject to any disclaimer, the term of this patent is extended or adjusted under 35 U.S.C. 154(b) by 0 days.

(21) Appl. No.: 13/827,492

(22) Filed: Mar. 14, 2013

(51) Int. Cl.
*A63F 9/26* (2006.01)

(52) U.S. Cl.
USPC ..... 273/450; 273/449

(58) Field of Classification Search
USPC ..... 273/440, 449, 450, 459
See application file for complete search history.

(56) References Cited

U.S. PATENT DOCUMENTS

| | | | | | |
|---|---|---|---|---|---|
| 1,851,223 | A * | 3/1932 | Watanabe | 40/493 |
| 3,081,999 | A * | 3/1963 | Harris | 273/449 |
| 3,202,424 | A * | 8/1965 | Patterson | 273/449 |
| 3,402,929 | A * | 9/1968 | Glass et al. | 273/447 |
| 3,614,106 | A * | 10/1971 | Morrison et al. | 273/156 |
| 3,764,134 | A * | 10/1973 | Reinertsen | 273/282.1 |
| 3,784,196 | A * | 1/1974 | Berlin | 273/449 |
| 3,960,376 | A * | 6/1976 | Berlin | 273/449 |
| 4,076,238 | A * | 2/1978 | Dively | 273/449 |
| 4,358,110 | A * | 11/1982 | Youkstetter | 273/450 |
| 5,181,727 | A * | 1/1993 | Fukumura | 273/450 |
| 7,303,193 | B2 * | 12/2007 | Miletich | 273/449 |
| 7,900,931 | B2 * | 3/2011 | Cornish | 273/450 |
| 2005/0017457 | A1 * | 1/2005 | Dubinsky | 273/440 |
| 2005/0093244 | A1 * | 5/2005 | Olsen | 273/450 |
| 2006/0022410 | A1 * | 2/2006 | Herbolich, Jr. | 273/449 |
| 2007/0090603 | A1 * | 4/2007 | Miletich | 273/449 |
| 2008/0237991 | A1 * | 10/2008 | Paul et al. | 273/450 |

* cited by examiner

*Primary Examiner* — Raleigh W Chiu
(74) *Attorney, Agent, or Firm* — Bush Intellectual Property Law; Kenneth M. Bush

(57) ABSTRACT

A balancing game apparatus comprising a vertically disposed elongated pole, a plurality of weighted members, and a pivotable top having a convex first surface, a second surface having a plurality of securing tabs, and an annular rim having a plurality of slots for receiving the weighted members therein. The elongated pole is operable to support the pivotable top in a first orientation wherein the convex surface of the pivotable top is balanced on the elongated pole and in a second orientation wherein the tabs on the concave surface reversibly secure the pivotable top to the elongated pole. The weighted members are placed in the slots while balancing the elongated pole. The first orientation corresponds to a greater difficulty level whereas the second orientation corresponds to an easier difficulty level.

8 Claims, 6 Drawing Sheets

BALANCING GAME APPARATUS

FIELD OF THE INVENTION

The present invention relates to amusement games, and more particularly, to a balancing game and apparatus for use therein.

BACKGROUND OF THE INVENTION

Various balancing amusement games are known in the art, such as that described in U.S. Pat. No. 7,303,193 to Miletich. These balancing games may be games of skill that require concentration, balance, and eye-hand coordination in ever-increasing amounts in order to improve and ultimately master the game. The present invention is directed to such skilled balancing games.

SUMMARY OF THE INVENTION

The present invention comprises a balancing apparatus having a vertically disposed elongated balance pole, a plurality of weighted members, and pivotable top. The balance pole preferably has an annular upper surface. Each weighted member preferably comprises a vertically disposed elongated rod having a spherical top and a weighted bottom. The pivotable top preferably has a convex surface, a concave surface having a plurality of tabs for reversibly securing the pivotable top to the annular upper surface, and an annular rim having a plurality of slots along the perimeter thereof for receiving the weighted members therein. The annular rim preferably has a first surface adjacent the convex surface and a second surface adjacent the concave surface. The balance pole is operable to support the pivotable top in a first orientation wherein the convex surface engages the annular upper surface such that the pivotable top is balanced on the balance pole. The second surface of the annular rim is operable to support the spherical tops of the weighted members thereon when the pivotable top is in the first orientation, thus allowing the weighted members to be hung from the pivotable top. The balance pole is further operable to support the pivotable top in a second orientation wherein the tabs on the concave surface engage the annular upper surface to reversibly secure the pivotable top to the annular upper surface. The first surface of the annular rim is operable to support the spherical tops of the weighted members thereon when the pivotable top is in the second orientation, thus allowing the weighted members to be hung from the pivotable top.

In use, the player decides whether to orient the pivotable top in the first or second orientation. The first orientation corresponds to a greater difficulty level (e.g. "expert") whereas the second orientation corresponds to an easier difficulty level (e.g. "beginner"). According to the first orientation (e.g. "expert"), the convex surface of the pivotable top is oriented downward and balanced on the annular upper surface of the balance pole. The bottom end of the balance pole is then preferably balanced on a player's hand or finger(s). The weighted members can then be placed in the slots such that the spherical top of each weighted member is supported on the second surface of the annular rim. Because the pivotable top is not secured to the annular upper surface but rather is balanced thereupon, the pivotable top will freely pivot in the direction of weight load as the weighted members are hung in the slots around the perimeter of the pivotable top. According to the second orientation (e.g. "beginner"), the concave surface of the pivotable top is oriented downward and the tabs are pushed into locking engagement with the annular upper surface to reversibly secure the pivotable top to the annular upper surface of the balance pole. The bottom end of the balance pole is then preferably balanced on a player's hand or finger(s). The weighted members can then be placed in the slots such that the spherical top of each weighted member is supported on the first surface of the annular rim. Because the pivotable top is secured to the annular upper surface, the pivotable top will not pivot in the direction of weight load as the weighted members are hung in the slots around the perimeter of the pivotable top.

These and other features of the invention will become apparent from the following detailed description of the invention.

DETAILED DESCRIPTION OF THE INVENTION

Figure 1:
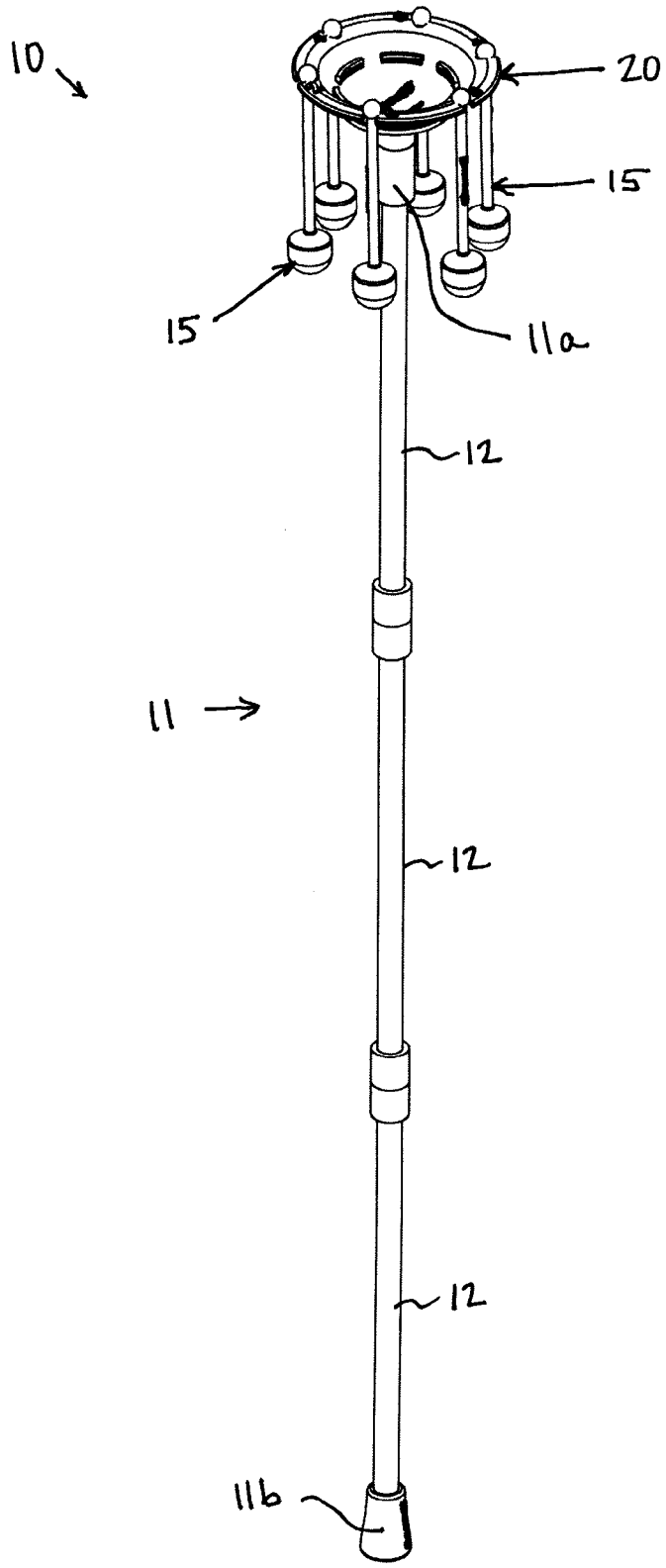
FIG. 1 is a perspective view of the balancing apparatus in a first orientation with the pivotable top balanced on the balance pole.
Figure 2:
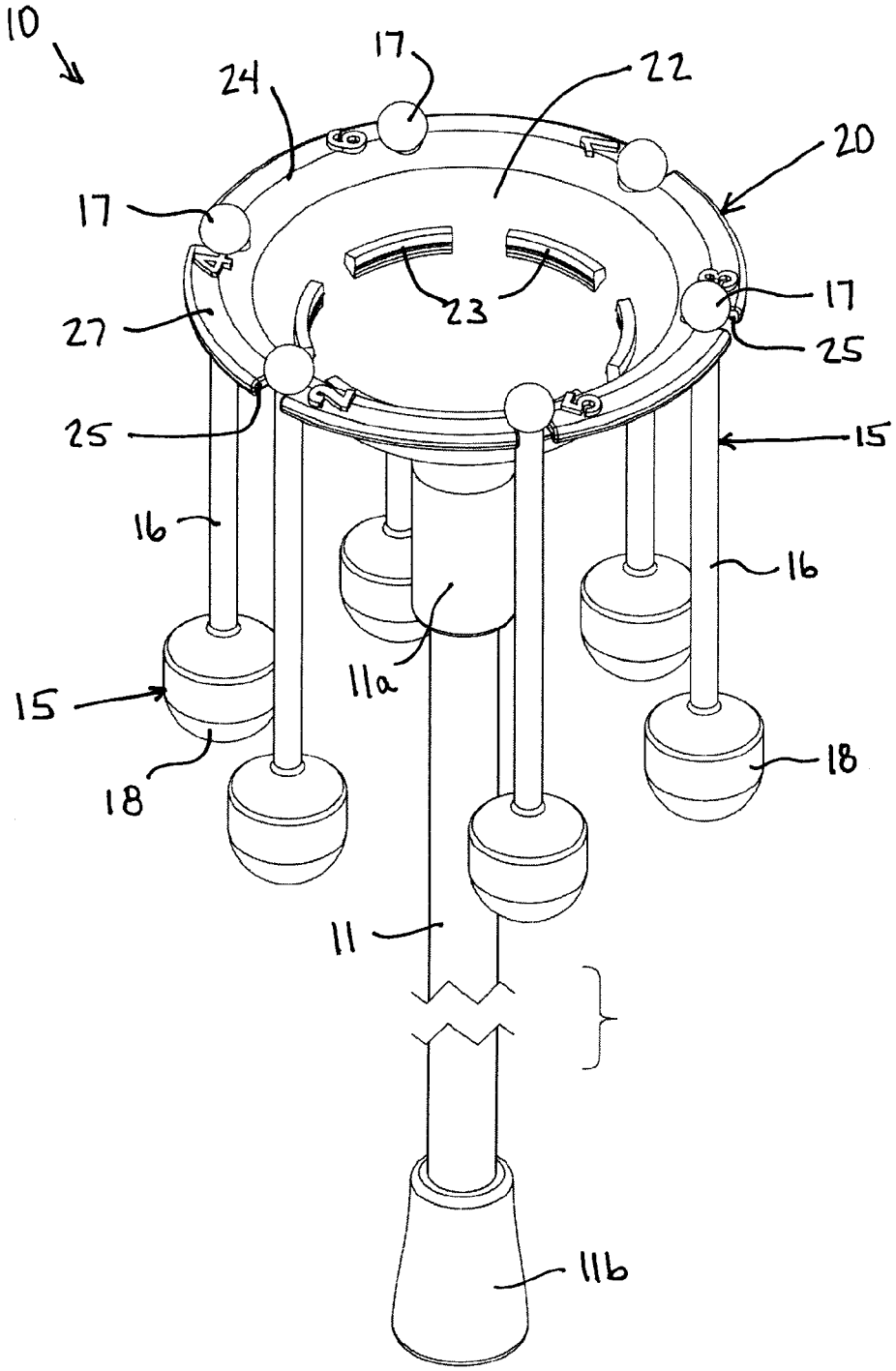
FIG. 2 is an enlarged perspective view of the balancing apparatus in the first orientation.
Figure 3:
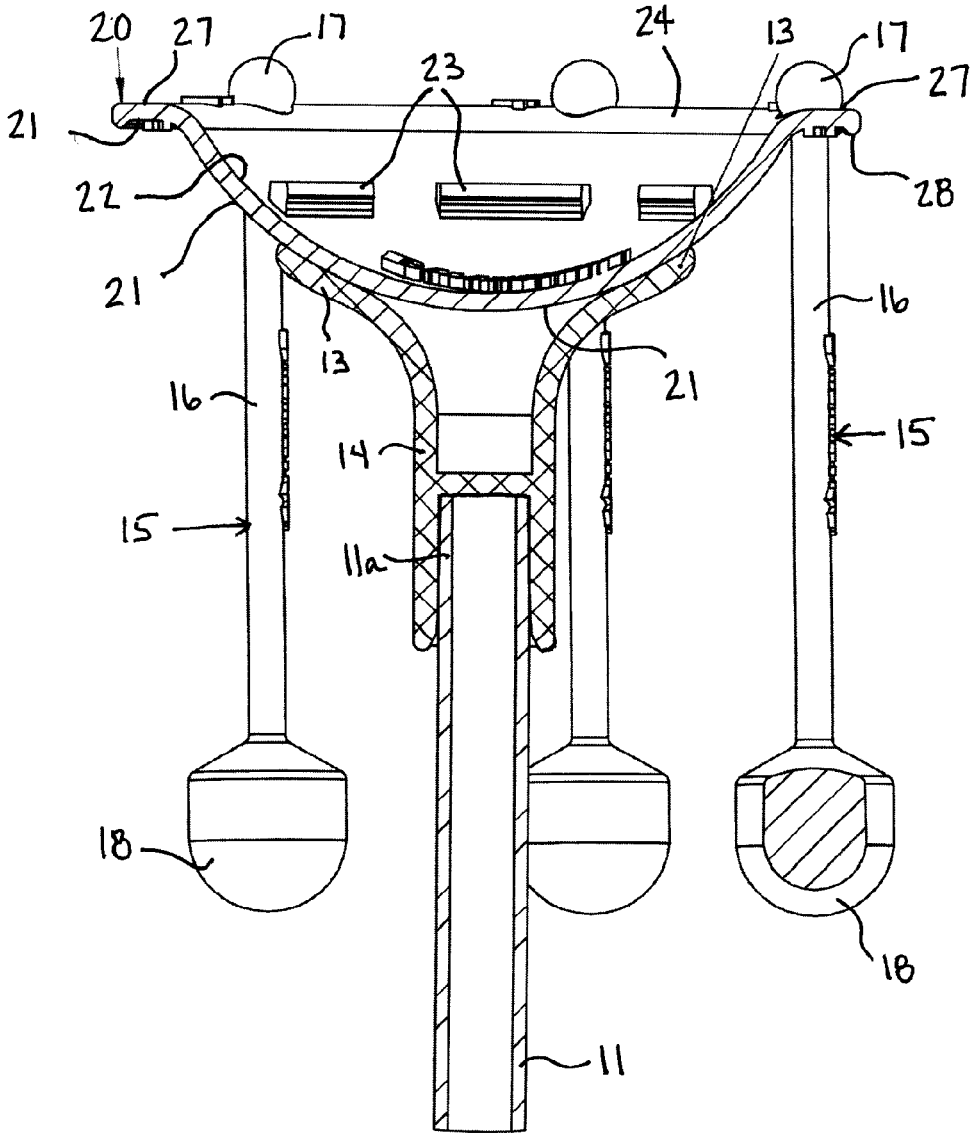
FIG. 3 is a side sectional view of the upper portion of the balancing apparatus in the first orientation.
Figure 4:
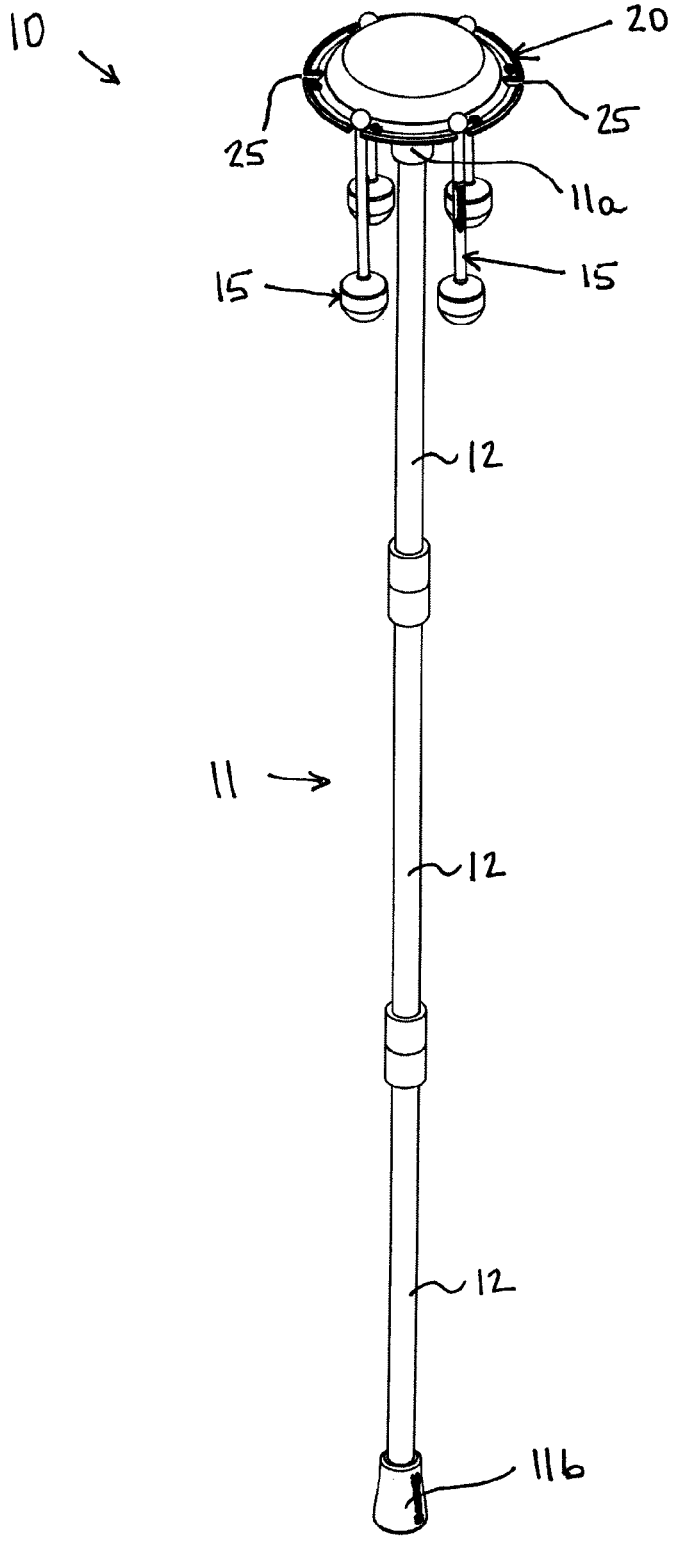
FIG. 4 is a perspective view of the balancing apparatus in a second orientation with the pivotable top inverted and reversibly attached to the balance pole.
Figure 5:
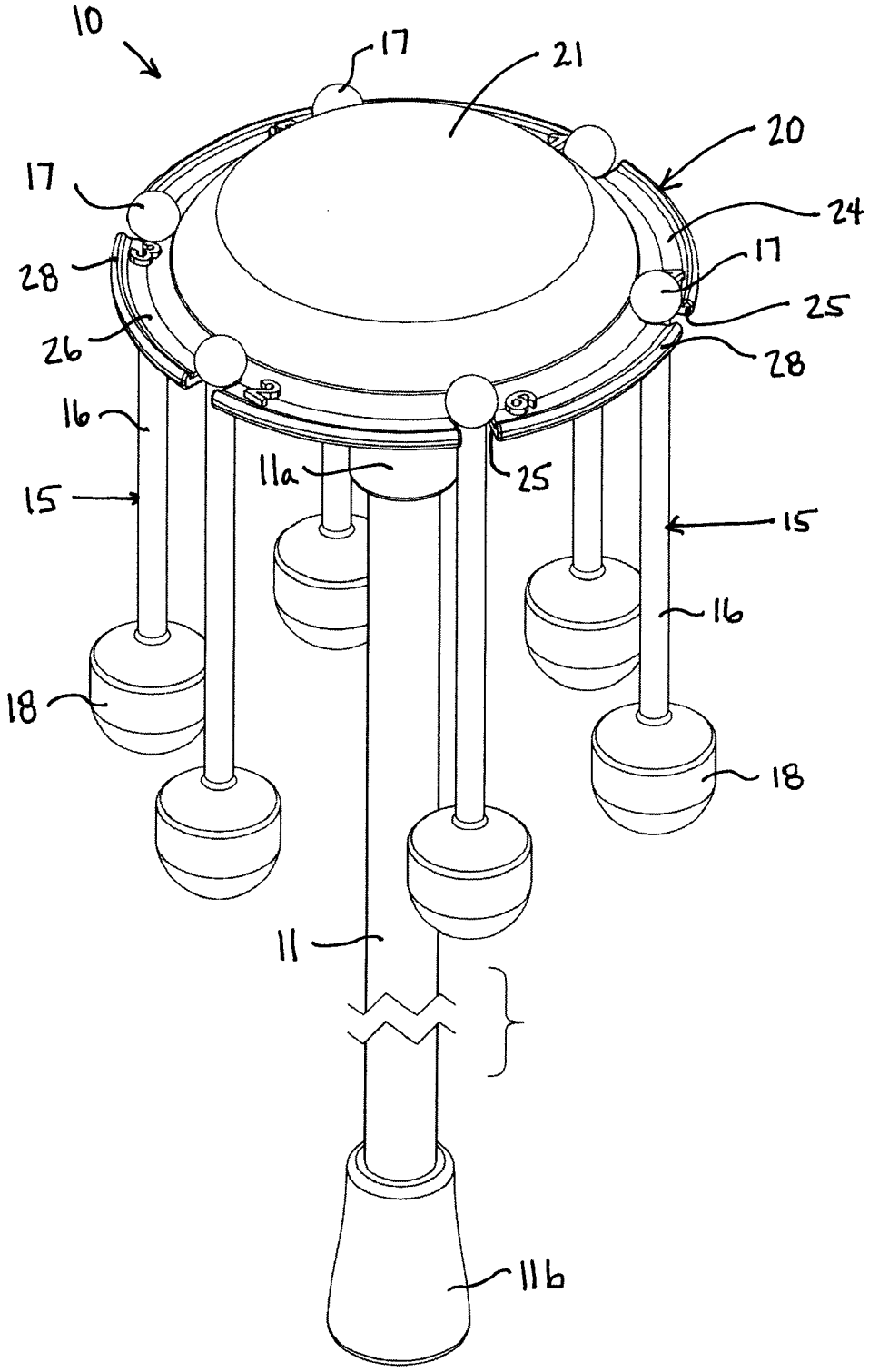
FIG. 5 is an enlarged perspective view of the balancing apparatus in the second orientation.
Figure 6:
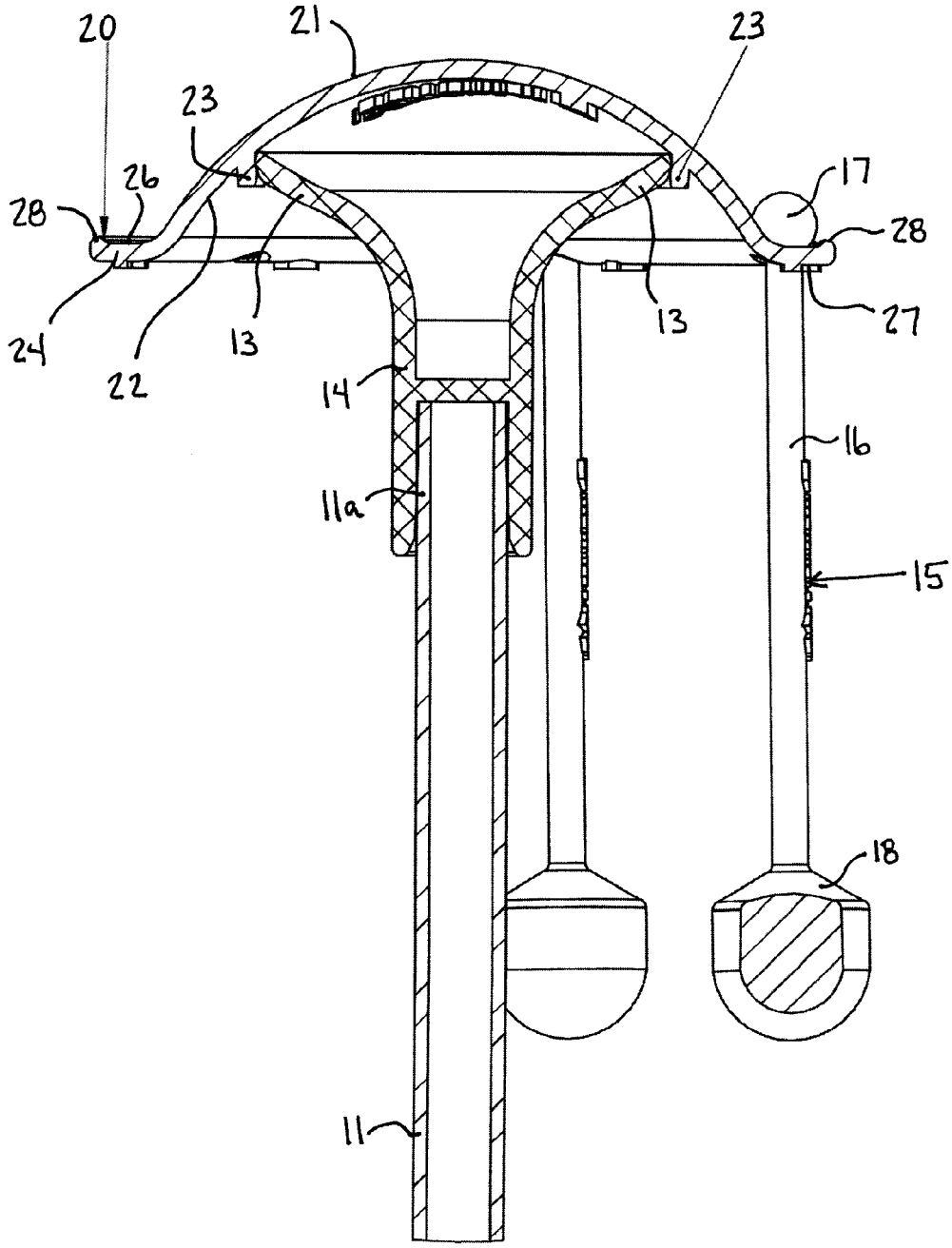
FIG. 6 is a side sectional view of the upper portion of the balancing apparatus in the second orientation.

The preferred embodiment of the present invention, shown in FIGS. 1-6, comprises a balancing apparatus 10 having a vertically disposed elongated balance pole 11, a plurality of weighted members 15, and pivotable top 20. The balance pole 11 is preferably adjustable in length, and may be telescoping or made of a plurality of removable sections 12. The balance pole preferably has a top end 11*a* having an annular upper surface 13 or, alternatively, the apparatus may include a connecting member 14 attached to the top end 11*a* wherein the connecting member 14 has an annular upper surface 13. Each weighted member 15 preferably comprises a vertically disposed elongated rod 16 having a spherical top 17 and a weighted bottom 18. The pivotable top 20 preferably is in the shape of a circular cup having a convex surface 21, a concave surface 22 having a plurality of tabs 23 for reversibly securing the pivotable top 20 to the annular upper surface 13, and an annular rim 24 having a plurality of slots 25 along the perimeter thereof for receiving the weighted members 15 therein. The annular rim 24 preferably has a first surface 26 adjacent the convex surface 21 and a second surface 27 adjacent the concave surface 22.

The balance pole 11 is operable to support the pivotable top 20 in a first orientation (FIGS. 1-3) wherein the convex surface 21 engages the annular upper surface 13 such that the pivotable top 20 is balanced on the balance pole 11. The second surface 27 of the annular rim 24 is operable to support the spherical tops 17 of the weighted members 15 thereon when the pivotable top 20 is in the first orientation, thus allowing the weighted members 15 to be hung from the pivotable top 20. The balance pole 11 is further operable to support the pivotable top 20 in a second orientation (FIGS. 4-6) wherein the tabs 23 on the concave surface 22 engage the annular upper surface 13 to reversibly secure the pivotable top 20 to the annular upper surface 13. The first surface 26 of the annular rim 24 is operable to support the spherical tops 17 of the weighted members 15 thereon when the pivotable top 20 is in the second orientation, thus allowing the weighted members 15 to be hung from the pivotable top 20. The first surface 26 of the annular rim 24 preferably has a vertically disposed lip 28 along the edge thereof to resist the spherical tops 17 of the weighted members 15 from sliding out of the slots 25 when the pivotable top 20 is in the second orientation.

In use, the length of the balance pole 11 is adjusted to the preference of the player. The player then decides whether to orient the pivotable top 20 in the first or second orientation. The first orientation (FIGS. 1-3) corresponds to a greater difficulty level (e.g. "expert") whereas the second orientation (FIGS. 4-6) corresponds to an easier difficulty level (e.g. "beginner"). While both levels require concentration, balance, and eye-hand coordination, the "expert" level is substantially more difficult than the "beginner" level.

According to the first orientation (FIGS. 1-3), the convex surface 21 of the pivotable top 20 is oriented downward and balanced on the annular upper surface 13 of the balance pole 11 (or connecting member 14). The bottom end 11*b* of the balance pole 11 is then preferably balanced on a player's hand or finger(s). The weighted members 15 can then be placed in the slots 25 such that the spherical top 17 of each weighted member 15 is supported on the second surface 27 of the annular rim 24. Because the pivotable top 20 is not secured to the annular upper surface 13 but rather is balanced thereupon, the pivotable top 20 will freely pivot in the direction of weight load as the weighted members 15 are hung in the slots 25 around the perimeter of the pivotable top 20. The goal is to hang all the weighted members 15 on the pivotable top 20 without (1) dropping the balance pole 11, (2) allowing the weighted members 15 to fall from the pivotable top 20, and (3) allowing the pivotable top 20 to fall from the balance pole 11.

According to the second orientation (FIGS. 4-6), the concave surface 22 of the pivotable top 20 is oriented downward and the tabs 23 are pushed into locking engagement with the annular upper surface 13 to reversibly secure the pivotable top 20 to the annular upper surface 13 of the balance pole 11. The bottom end 11*b* of the balance pole 20 is then preferably balanced on a player's hand or finger(s). The weighted members 15 can then be placed in the slots 25 such that the spherical top 17 of each weighted member 15 is supported on the first surface 26 of the annular rim 24. Because the pivotable top 20 is secured to the annular upper surface 13, the pivotable top 20 will not pivot in the direction of weight load as the weighted members 15 are hung in the slots around the perimeter of the pivotable top 20. In addition, the vertically disposed lip 28 along the edge of the first surface 26 of the annular rim 24 resists the spherical tops 17 of the weighted members 15 from sliding out of the slots 25; however, the weighted members 15 can fall from the pivotable top 20 if the balance pole 11 leans far enough from a vertical orientation. The goal is to hang all the weighted members 15 on the pivotable top 20 without (1) dropping the balance pole 11 and (2) allowing the weighted members 15 to fall from the pivotable top 11.

While the invention has been shown and described in some detail with reference to specific exemplary embodiments, there is no intention that the invention be limited to such detail. On the contrary, the invention is intended to include any alternative or equivalent embodiments that fall within the spirit and scope of the invention as shown and described herein and as recited in the appended claims.

The invention claimed is:

1. A balancing apparatus, comprising:

a. a vertically disposed elongated pole having a top end and a bottom end, wherein said top end comprises an annular upper surface;

b. a plurality of weighted members; and c. a pivotable top having a convex first surface, a second surface having a plurality of tabs for reversibly securing said pivotable top to said annular upper surface of said elongated pole, and an annular rim having a plurality of slots along the perimeter thereof for receiving said weighted members therein;

d. wherein said elongated pole is operable to support said pivotable top in a first orientation wherein said convex first surface engages said annular upper surface such that said pivotable top is balanced on said elongated pole; and e. wherein said elongated pole is further operable to support said pivotable top in a second orientation wherein said tabs on said second surface engage said annular upper surface to reversibly secure said pivotable top to said elongated pole.

2. An apparatus according to claim 1, wherein said elongated pole is adjustable in length.

3. An apparatus according to claim 1, wherein each weighted member comprises a vertically disposed elongated rod having a spherical top and a weighted bottom.

4. An apparatus according to claim 3, wherein said annular rim of said pivotable top has a first surface adjacent said convex first surface and a second surface adjacent said second surface of said pivotable top, wherein said second surface of said annular rim is operable to support the spherical tops of said weighted members thereon when said pivotable top is in said first orientation, and wherein said first surface of said annular rim is operable to support the spherical tops of said weighted members thereon when said pivotable top is in said second orientation.

5. An apparatus according to claim 4, wherein said first surface of said annular rim has a vertically disposed lip along the edge thereof to resist the spherical tops of said weighted members from sliding out of said slots when said pivotable top is in said second orientation.

6. A balancing apparatus, comprising:

a. a vertically disposed elongated pole having a top end and a bottom end;

b. a connecting member attached to said top end of said elongated pole, wherein said connecting member comprises an annular upper surface;

c. a plurality of weighted members, wherein each weighted member comprises a vertically disposed elongated rod having a spherical top and a weighted bottom; and d. a circular cup having a convex surface, a concave surface having a plurality of tabs for reversibly securing said circular cup to said annular upper surface of said connecting member, and an annular rim having a plurality of slots along the perimeter thereof for receiving said weighted members therein, wherein said annular rim has a first surface adjacent said convex surface and a second surface adjacent said concave surface;

e. wherein said connecting member is operable to support said circular cup in a first orientation wherein said convex surface engages said annular upper surface such that said circular cup is balanced on said connecting member, wherein said second surface of said annular rim is operable to support the spherical tops of said weighted members thereon when said circular cup is in said first orientation;

f. wherein said connecting member is further operable to support said circular cup in a second orientation wherein said tabs on said concave surface engage said annular upper surface to reversibly secure said circular cup to said connecting member, wherein said first surface of said annular rim is operable to support the spherical tops of said weighted members thereon when said circular cup is in said second orientation.

7. An apparatus according to claim 6, wherein said elongated pole is adjustable in length.

8. An apparatus according to claim 6, wherein said first surface of said annular rim has a vertically disposed lip along the edge thereof to resist the spherical tops of said weighted members from sliding out of said slots when said circular cup is in said second orientation.

* * * * *